US005506494A

United States Patent [19]

Ito et al.

[11] Patent Number: 5,506,494

[45] **Date of Patent: *Apr. 9, 1996**

[54] RESISTOR CIRCUIT WITH REDUCED TEMPERATURE COEFFICIENT OF RESISTANCE

[75] Inventors: Hajime Ito, Ichinomiya; Takashi Nagasaka, Anjo, both of Japan

[73] Assignee: Nippondenso Co., Ltd., Kariya, Japan

[ * ] Notice: The term of this patent shall not extend beyond the expiration date of Pat. No. 5,254,938.

[21] Appl. No.: 95,410

[22] Filed: Sep. 13, 1993

Related U.S. Application Data

[63] Continuation-in-part of Ser. No. 871,345, Apr. 21, 1992, Pat. No. 5,254,938.

[30] Foreign Application Priority Data

Apr. 26, 1991 [JP] Japan ..... 3-125526
Jun. 11, 1991 [JP] Japan ..... 3-166491

[51] Int. Cl.[6] ..... G05F 1/567

[52] U.S. Cl. ..... 323/280; 323/369; 323/907; 338/325; 338/328

[58] Field of Search ..... 323/273, 277, 323/280, 369, 907; 338/322, 325, 328

[56] References Cited

U.S. PATENT DOCUMENTS

| | | | |
|---|---|---|---|
| 3,705,316 | 12/1972 | Burrow et al. | 323/907 |
| 3,836,340 | 9/1974 | Conwicke | 338/20 |
| 4,101,820 | 7/1978 | Montanari | 323/369 |
| 4,181,878 | 1/1980 | Murari et al. | 323/369 |
| 4,317,054 | 2/1982 | Caruso et al. | 323/313 |
| 4,331,949 | 5/1982 | Kagawa | 338/325 |
| 4,332,081 | 6/1982 | Francis | 338/308 |
| 4,531,111 | 7/1985 | Schmidt et al. | 323/369 |
| 4,570,115 | 2/1986 | Misawa et al. | 323/313 |
| 4,584,553 | 4/1986 | Tokura et al. | 338/320 |
| 4,940,930 | 7/1990 | Detweiler | 323/280 |
| 4,952,902 | 8/1990 | Kawaguchi et al. | 338/22 R |
| 5,012,178 | 4/1991 | Weiss et al. | 323/312 |
| 5,130,635 | 7/1992 | Kase | 323/280 |
| 5,225,766 | 7/1993 | O'Neill | 323/273 |
| 5,291,123 | 3/1994 | Brown | 323/369 |

FOREIGN PATENT DOCUMENTS

| | | | |
|---|---|---|---|
| 62-169301 | 7/1987 | Japan | H01C 7/00 |

OTHER PUBLICATIONS

IEEE Transactions on components, hybrids, and manufacturing technology, vol. CHMT–7, No. 2, Jun. 1984, "The Microstructure of RUO2 Thick Film Resistors & the Influence of Glass Prticle Size on their Electrical Properties". Toshio Inokuma, et al.

*Primary Examiner*—Jeffrey L. Sterrett
*Attorney, Agent, or Firm*—Cushman, Darby & Cushman

[57] ABSTRACT

A resistor circuit includes a pair of linear conductive films and a resistive film. The resistive film is formed on an area between the conductive films and electrically connected to the conductive films. A pair of terminals are electrically connected to portions of the conductive films respectively. A current source is electrically connected between the terminals to deliver an electrical current thereto. A pair of voltage output terminals are electrically connected to portions of the conductive films respectively. At least one of the voltage output terminals is disposed at a portion of the conductive films other than a portion at which the terminals are formed. An output voltage from the voltage output terminals is exactly proportional to a current flowing between them independent of changes in an ambient temperature. The circuit may be implemented in an integrated circuit environment using, e.g., multiple thin film resistors.

29 Claims, 8 Drawing Sheets

RESISTOR CIRCUIT WITH REDUCED TEMPERATURE COEFFICIENT OF RESISTANCE

This application is a continuation-in-part of application Ser. No. 07/871,345, filed Apr. 21, 1992, now U.S. Pat. No. 5,254,938.

BACKGROUND OF THE INVENTION

1. Filed of the Invention

The present invention relates to a resistor circuit in which a resistor has a reduced TCR (Temperature Coefficient of Resistance).

2. Description of the Related Art

FIG. 6 shows a conventional constant-current circuit. A resistor 5 is connected to an emitter terminal of a transistor 3 for detecting a current which is fed back to an operational amplifier 4. The operational amplifier 4 controls the transistor 3 so that the voltage of a connecting point between the emitter terminal and the resistor 5 corresponds to a constant-voltage Vc. Thus, the circuit keeps a current which flows into a lead 6 constant.

When such a circuit is constructed by a so-called hybrid IC (Integrated Circuit), a thick-film resistor is generally used as the resistor 5. However, when sheet-resistivity of the thick-film resistor is approximately less than $1\Omega/_{58}$ , the thick-film resistor tends to behave metallically. More specifically, the TCR of the thick-film resistor becomes more than +500 ppm/°C. In this case, the resistance of the resistor 5 changes in accordance with variations in ambient temperature. Therefore, the voltage which is fed back to the operational amplifier 4 is changed because of the resistance variation, and this voltage change will vary the current. Therefore, the circuit can not keep the current constant.

A conventional electrode structure for the resistor 5 is shown in FIG. 7. The TCR of a resistive film 2 is comparatively low (approximately +150 ppm/°C.), and its resistance is high. The resistive film 2 is formed on a wide area between linear conductive films 1A and 1B to make resistance between the conductive films 1A and 1B. A terminal 20 shown in FIG. 7 is connected to the emitter terminal shown in FIG. 6, and a terminal 21 is connected to the operational amplifier 4. However, even such an electrode structure has not been able to sufficiently lower the TCR of the resistor 5 to enable constant current in changing ambient temperatures.

SUMMARY OF THE INVENTION

Accordingly, it is an objective of the present invention to provide a resistor circuit in which a resistor has a reduced TCR, lowered enough to allow use in a constant current circuit without effects from ambient temperature.

To accomplish the foregoing and other objects and in accordance with the purpose of the present invention, a resistor circuit which includes a pair of linear conductive films and a resistive film as FIG. 1 shows the preferred embodiment, where the resistive film 2 is formed on an area between the conductive films 1A and 1B and electrically connected to the conductive films 1A and 1B. A pair of terminals (11A and 11B in FIG. 1) are electrically connected to portions of the conductive films respectively. A current source is electrically connected between the terminals to produce an electric current between the terminals. A pair of voltage output terminals are electrically connected to portions of the conductive films; at least one of the voltage output terminals is disposed at a position other than a position in which the terminals 1A and 1B are formed.

This resistor circuit forms the resistive film as a resistor ladder in which four resistances are connected to voltage $V_1$ is the voltage between the voltage output terminal each other like a ladder as shown in FIGS. 2A and 2B. A 13A near the terminal 11A and the conductive film 1B. When the atmospheric temperature rises, the resistance Rr of the resistive film 2 rises, and a current $I_1$ flowing in the resistance Rr rises the causing the voltage $V_1$ to rise. A voltage $V_2$ is defined between the voltage output terminal 13B far from the terminal 11B and the conductive film 1A. When the atmospheric temperature rises, the resistance Rr also rises, a current 12 through the resistance Rr is lowered because the resistance Rc of the conductive films 1A and 1B rises. The voltage $V_2$ is therefore lowered, because the amount of lowering the current 12 is larger than the amount of voltage caused by the rise of the resistance Rr. Therefore, when the ambient temperature rises, the voltage $V_2$ is lowered.

As a result, when the ambient temperature rises, the voltage $V_1$ rises and the voltage $V_2$ lowers. By disposing the voltage output terminals 13A and 13B at different positions the voltage $V_1$ offset the voltage $V_2$. An output voltage output from the voltage output terminals 13A and 13B is therefore independent of the change of the ambient temperature.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DESCRIPTION OF THE PREFERRED EMBODIMENTS

The preferred embodiments of the present invention will now be described with reference to the drawings.

(First Embodiment)

Figure 1:
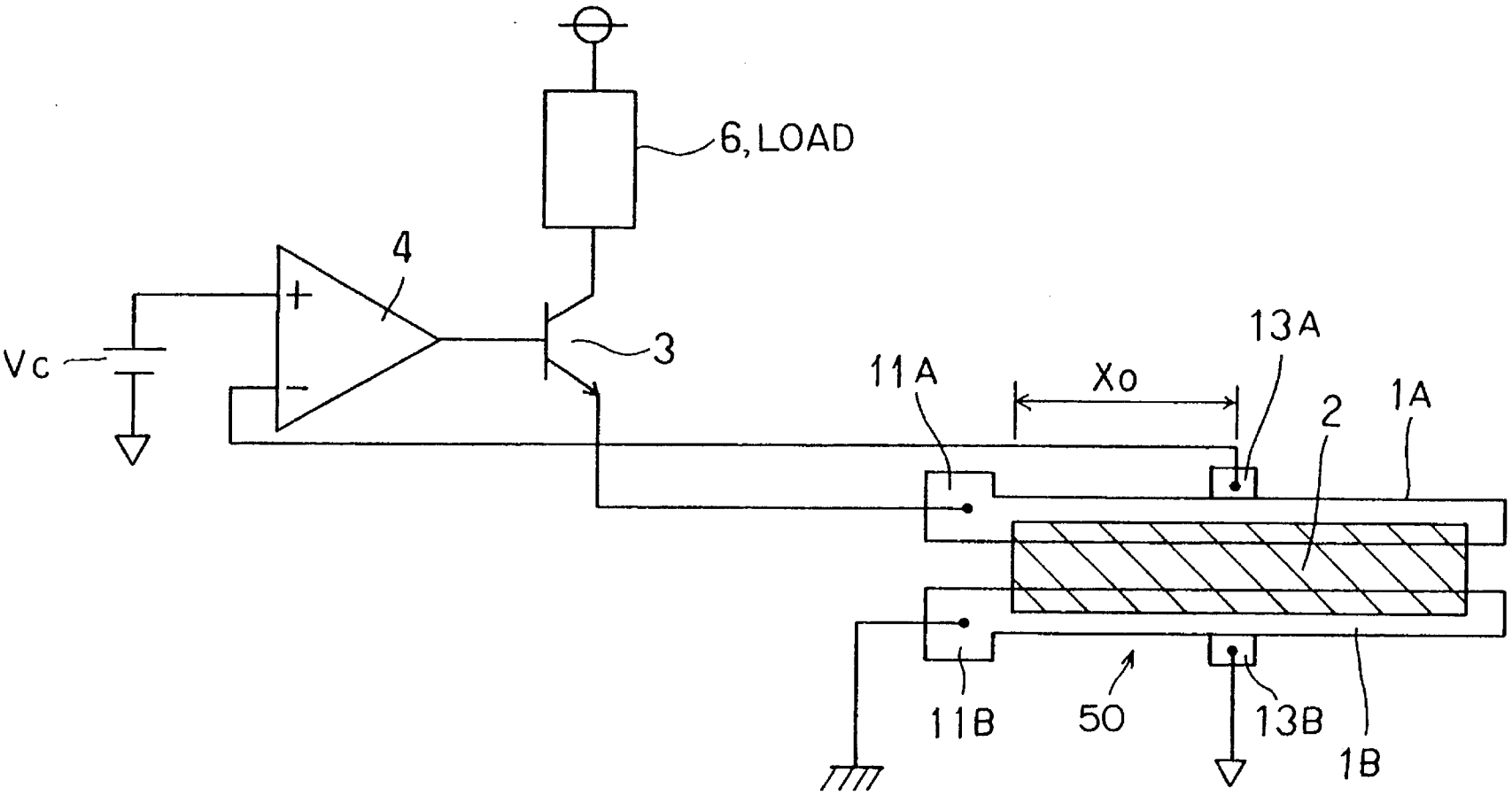
FIG. 1 shows a constant-Current circuit in which a resistor circuit according to an embodiment is used.
Figure 2A:
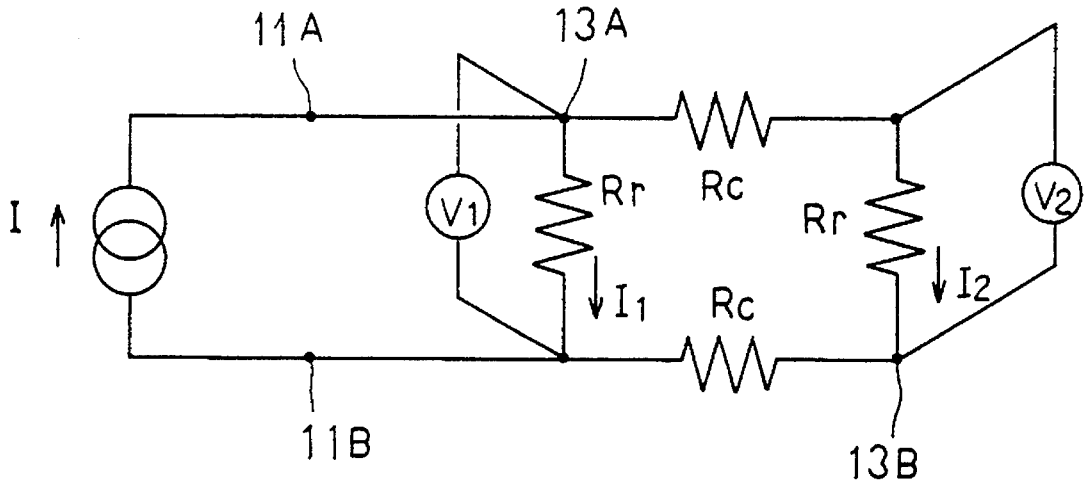
FIGS. 2A and 2B are conceptual views for explaining the present invention.
Figure 2B:
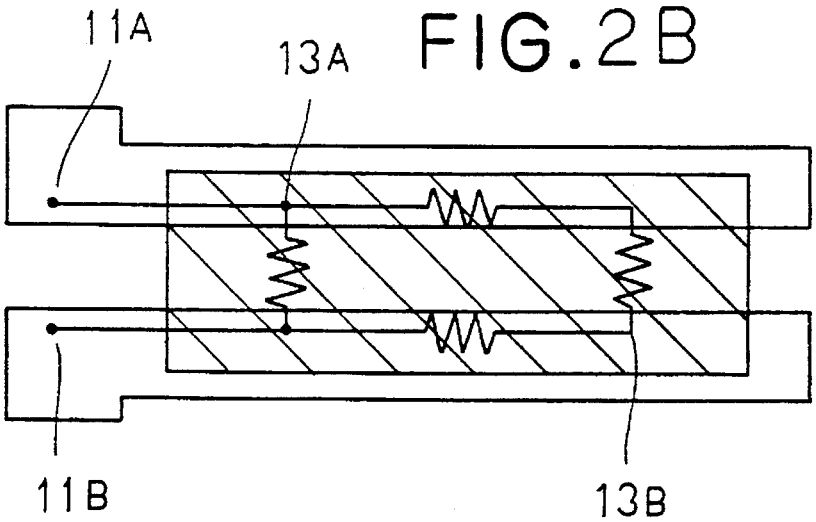

FIG. 1 shows a constant-current circuit in which a resistor 50 according to a first embodiment of the present invention is used. Linear conductive films 1A and 1B are formed parallel to one another. A rectangular resistive film 2 is formed on an area between the conductive films 1A and 1B. One side of the resistive film 2 is electrically connected to the conductive film 1A, and another side, opposite to the one side, is electrically connected to the conductive film 1B. The resistor 5 is composed of the conductive films 1A and 1B and the resistive film 2. A supply voltage terminal 11A is connected to one end of the conductive film 1A. The supply voltage terminal 11A is connected to an emitter terminal of a transistor 3. The transistor 3 is a current source for the resistor 5. A ground terminal 11B is connected to one end of the conductive film 1B. The one end of the conductive film 1B is grounded to a power supply ground line. The one end of the conductive film 1A and the one end of the conductive film 1B are formed on the same side.

A voltage output terminal 13A is connected to the conductive film 1A and is disposed at a predetermined distance Xo from one end of the resistive film 2 where the supply voltage terminal 11A is located. The voltage output terminal 13A is connected to an inverting input terminal of an operational amplifier 4. A voltage output terminal 13B is connected to the conductive film 1B and is disposed at the predetermined distance Xo from the one end of the resistive film 2. The voltage output terminal 13B is grounded to a logic ground line.

A constant-voltage Vc is connected between a non-inverting input terminal of the operational amplifier 4 and the logic ground line. This constant voltage can be from a zener diode, or 3-terminal regulator, for example. An output terminal of the operational amplifier 4 is connected to a base terminal of the transistor 3. Load 6 is connected between a collector terminal of the transistor 3 and a power supply.

A load current flows into the supply voltage terminal 11A through the transistor 3, flows in the resistor 50, and flows from the ground terminal 11B to the power supply ground line. The voltage between the voltage output terminals 13A and 13B is proportional to the current. The voltage is compared with the constant-voltage Vc by the operational amplifier 4, which produces an output signal in accordance with the difference between the voltage and the constant-voltage Vc to the transistor 3. The transistor 3 is controlled by the output signal so that a constant-current flows in the load 6.

The voltage between the voltage output terminals 13A and 13B is kept constant regardless of any variation of ambient temperature by disposing the voltage output terminals 13A and 13B at the distance Xo.

The preferred way of determining distance Xo will be described with reference to FIGS. 3–5.

Figure 3:
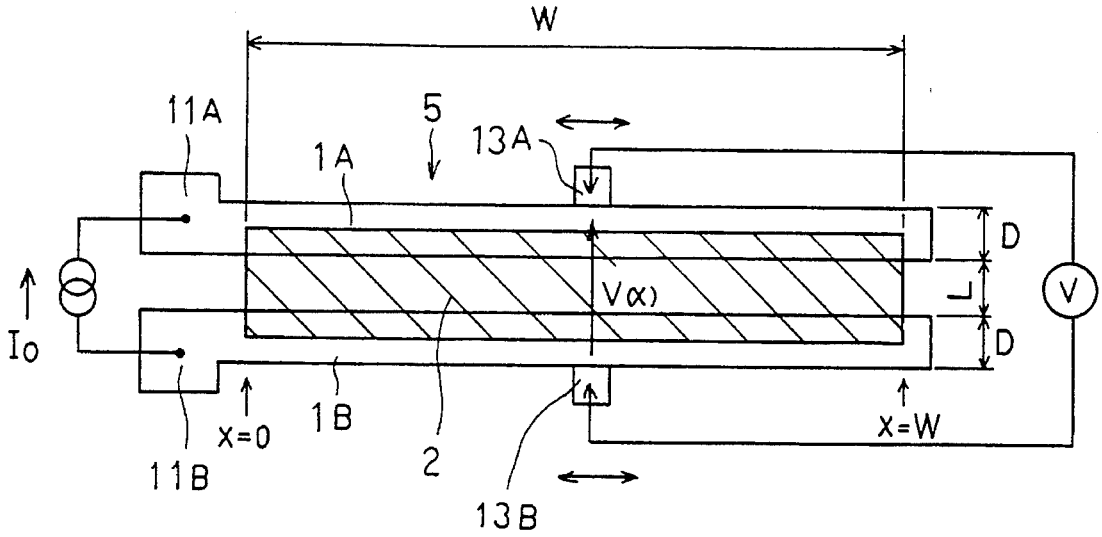
FIG. 3 is a schematic view of the electrode structure shown in FIG. 1.
Figure 4:
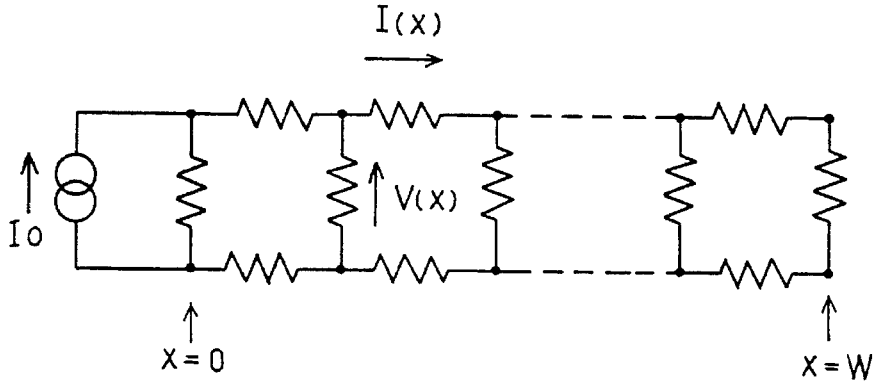
FIG. 4 shows a distributed parameter circuit constructed by a resistor ladder.

A distance X is defined as the distance from the one end of the resistive film 2 in FIG. 3. The one end is the closest portion of the resistive film 2 to the supply voltage terminal 11A or the ground terminal 11B, The resistor 50 is regarded as a distributed parameter circuit constructed by a resistor ladder equivalently shown in FIG. 4. The distributed parameter circuit is represented by the following partial differential equations (1) and (2):

$$\frac{\partial V(x)}{\partial x} = -RI(x) \tag{1}$$

$$\frac{\partial I(x)}{\partial x} = -GV(x) \tag{2}$$

wherein R denotes double the resistance per unit length of the conductive films 1A and 1B; and G denotes the conductance per unit length of the resistive film 2.

Voltage V(X) is represented by the following equation (3) by solving the equations (1) and (2), wherein boundary condition is as follows: I(0)=Io; I(W)=0.

$$V(x) = \sqrt{\frac{R}{G}} \cdot Io \cdot \frac{\cosh(\sqrt{RG}\ (W-x))}{\sinh(\sqrt{RG}\ W)} \tag{3}$$

wherein, W denotes the width of the resistive film 2.

When the ambient temperature changes, R, G and V(X) are denoted by R', G' and V' (X) respectively. In this case, the change V(X) of the voltage is represented by the following equation (4):

$$\Delta V(x) = Io\left(\sqrt{\frac{R'}{G'}} \cdot \frac{\cosh(\sqrt{R'G'}\ (W-x))}{\sinh(\sqrt{R'G'}\ W)} - \sqrt{\frac{R}{G}} \cdot \frac{\cosh(\sqrt{RG}\ (W-x))}{\sinh(\sqrt{RG}\ W)}\right) \tag{4}$$

When the conductive films 1A and 1B are made of, for example, Ag—Pt, its TCR is +2000 ppm/°C., and sheet-resistivity is 3M Ω/□. When the resistive film 2 is made of, for example, resistive material including $RuO_2$ as base material, its TCR is +100 ppm/°C., and sheet-resistivity is 3Ω/□. Here, suppose that the temperature of the atmosphere changes by 100° C. in the range of 25° C.–125° C., the width D of the conductive films 1A and 1B and the length L of the resistive film 2 are both 1 mm, and the current Io flowing between the conductive films 1A and 1B is 1 ampere. The necessary condition on which the distance Xo exists is ΔV{(W)<0, wherein the distance Xo satisfies the following equation: ΔV(Xo)=0. In this case, the above-mentioned equation (4) is transformed into the following equation (5), and $\sqrt{R'/R}$ and $\sqrt{G/G'}$ in the equation (5) are calculated as shown in the following equations (6) and (7) respectively:

$$\sqrt{\frac{R'}{R}} \cdot \sqrt{\frac{G}{G'}} \cdot \sinh(\sqrt{RG}\ W) - \sinh(\sqrt{R'G'}\ W) < 0 \tag{5}$$

$$\sqrt{\frac{R'}{R}} = \sqrt{1 + 2000\ \text{ppm/°C.} \times 100°\ \text{C.}} = \sqrt{1.2} \tag{6}$$

$$\sqrt{\frac{G}{G'}} = \sqrt{1 + 100\ \text{ppm/°C.} \times 100°\ \text{C.}} = \sqrt{1.01} \tag{7}$$

Substituting the equations (6) and (7) for the equation (5) arrives at the following equation: $RGW^2>0.325$. Furthermore, this equation is transformed into the following equation: $W^2/DL>1.63\times10^2$. Solving this equation finds that W>13.

Therefore, the distance Xo need be any width W is more than 13 mm. For example, when the width W is 25 mm, the relationship between the distance X and the voltage V(x) is shown in FIG. 5, wherein the temperatures of the atmosphere are 25° C. and 125° C. FIG. 5 shows the distance Xo is 10 mm.

As explained above, according to the electrode structure of the present embodiment, because the voltage output terminals 13A and 13B are disposed at the above-mentioned distance Xo, the output voltage between the voltage output terminals 13A and 13B is exactly proportional to the current flowing between them without an influence of change of the atmospheric temperature. Namely, the equivalent TCR of the resistor 5 is substantially zero(0).

(Second Embodiment)

Figure 5:
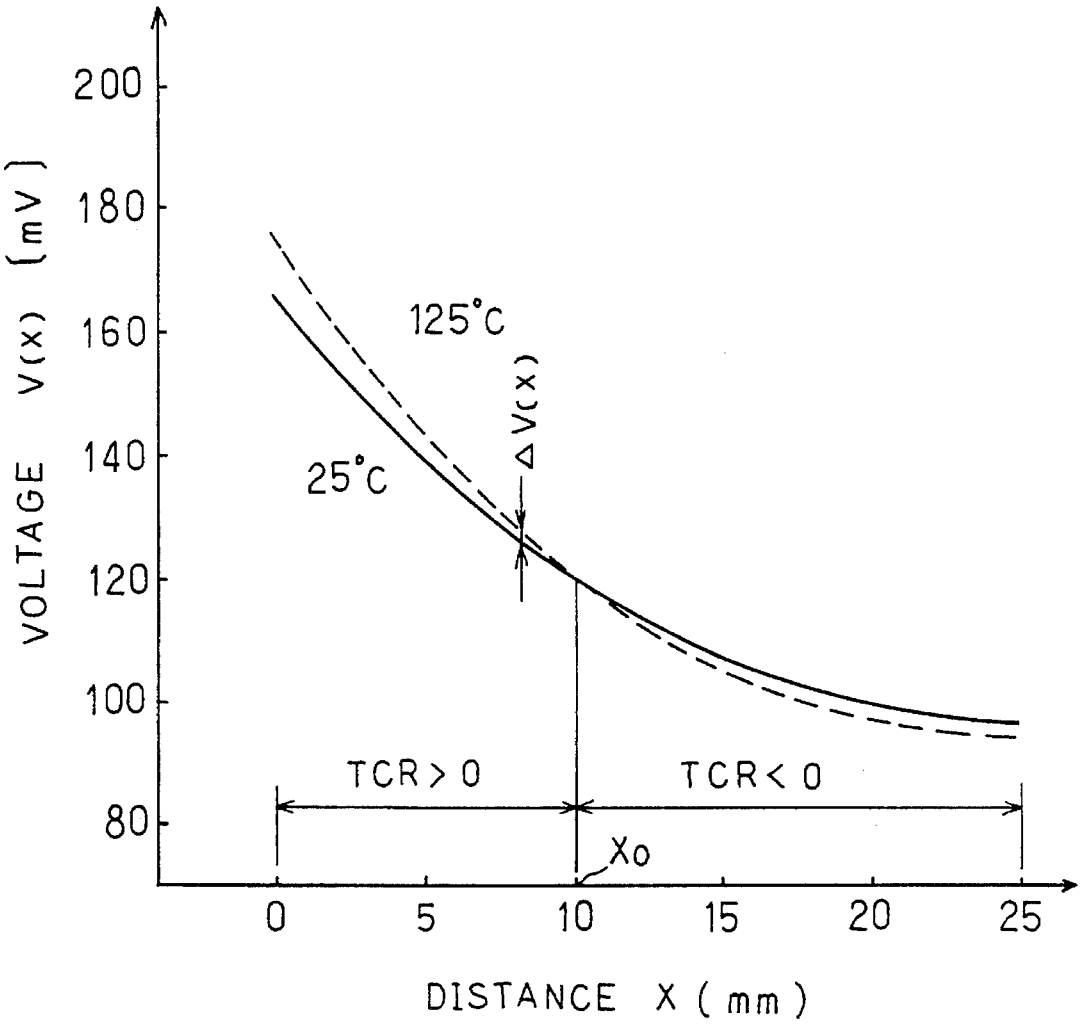
FIG. 5 shows the relationship between a distance X and a voltage V(X)
Figure 6:
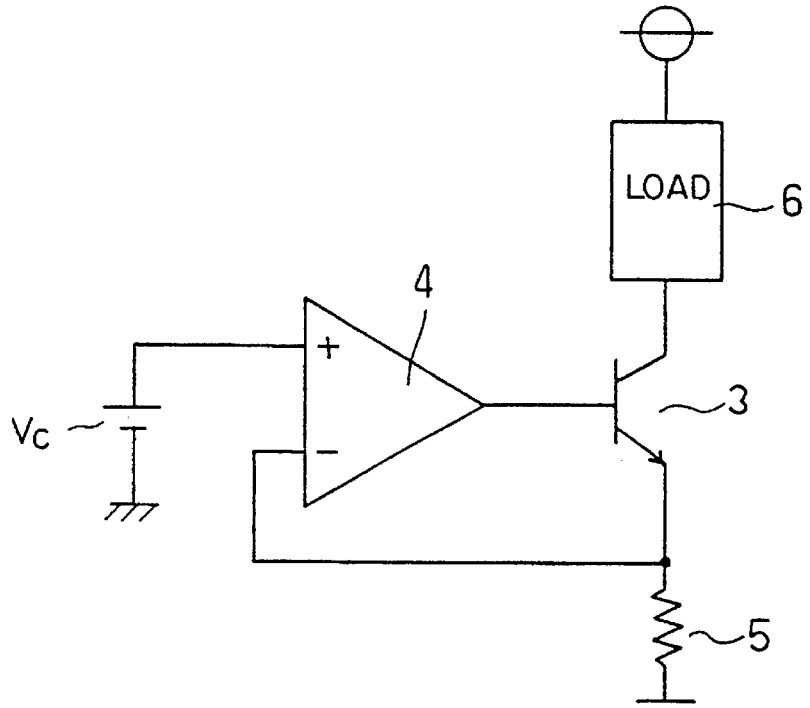
FIG. 6 (PRIOR ART)
FIG. 6 shows a conventional constant-current circuit.
Figure 8:
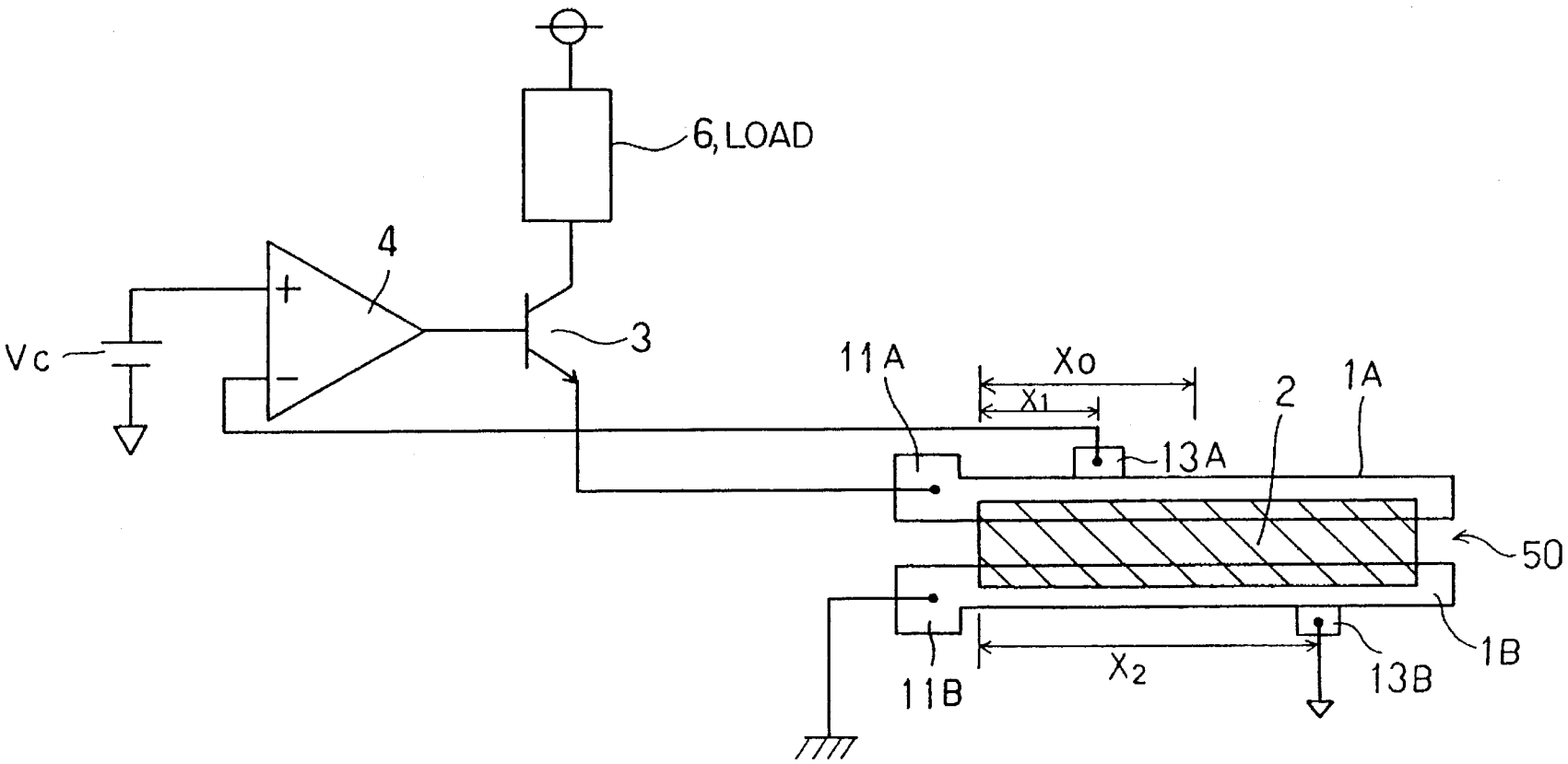
FIG. 8 shows a constant-current in which a resistor circuit according to a second embodiment is used.

FIG. 5 shows that when the distance X is longer than the distance Xo, the change ΔV(X) of the voltage becomes negative. The longer the distance X, the larger the absolute value of the change ΔV(X). When both the voltage output terminals 13A and 13B cannot be disposed at the same distance Xo due to spatial restriction, the voltage output terminals 13A and 13B may be disposed at the distance X1 and X2, respectively, wherein $\Delta V(X1)=-\Delta V(X2)$. The distance X1 is shorter than the distance Xo, and the distance X2 is longer than, the distance Xo as shown in FIG. 8. The second embodiment has the same effect as the first embodiment.

(Third Embodiment)

Figure 7:
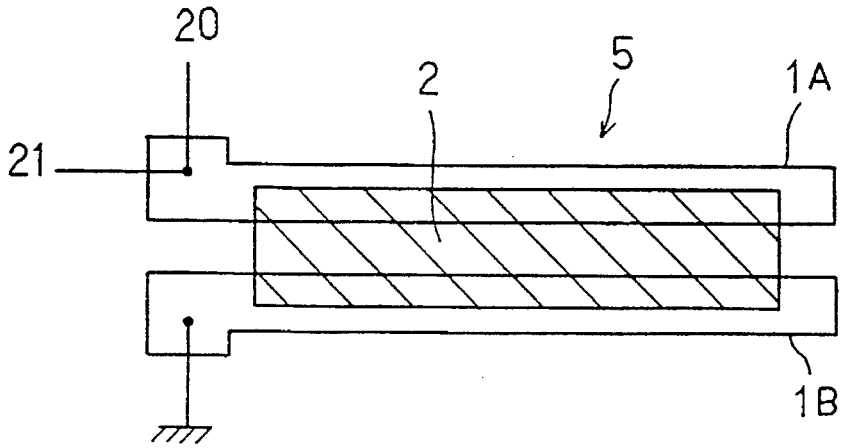
FIG. 7 (PRIOR ART)
FIG. 7 is a schematic view of a conventional electrode structure.
Figure 9:
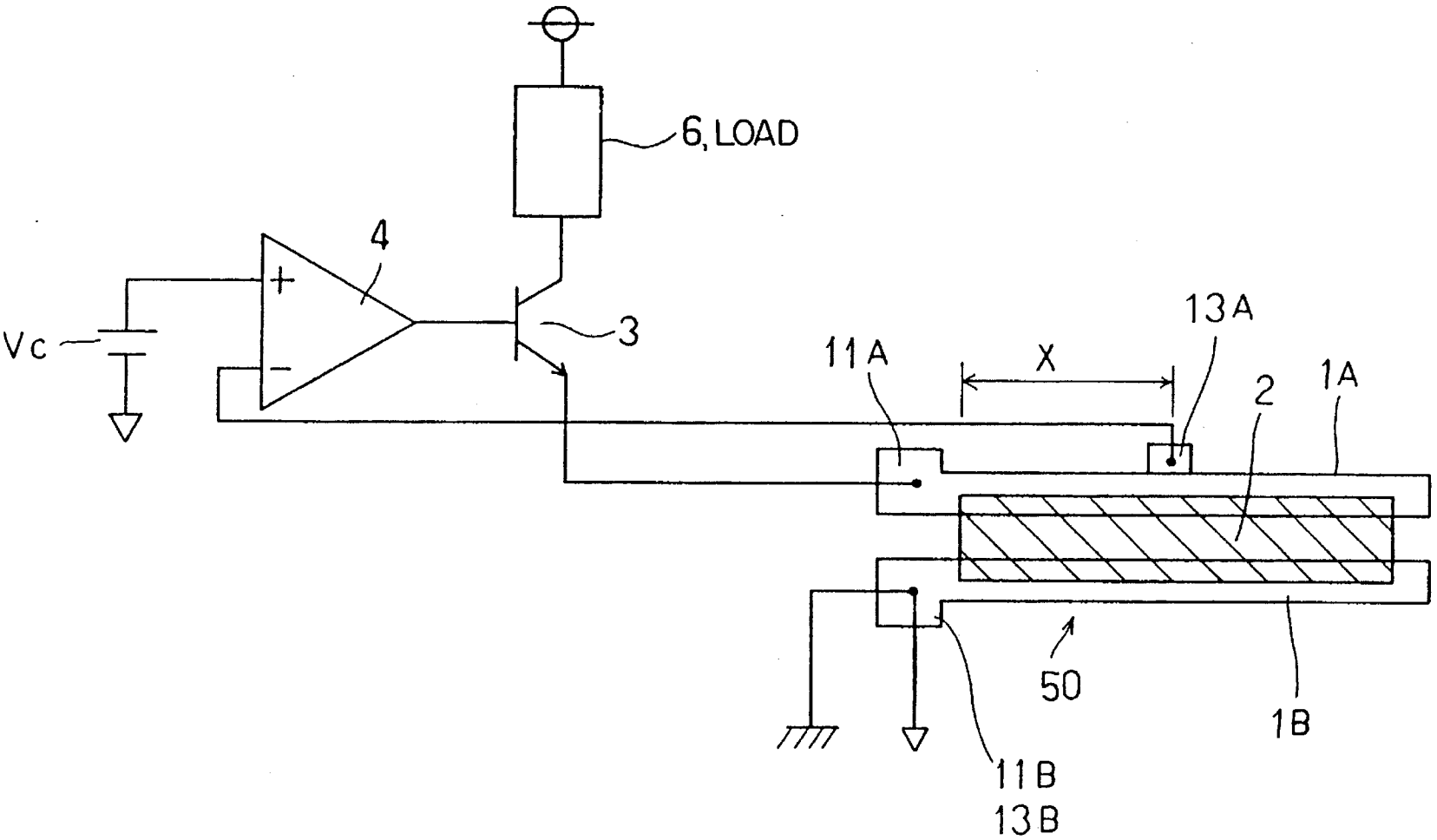
FIG. 9 shows a constant-current circuit in which a resistor circuit according to a third embodiment is used.

One of the voltage output terminals 13A and 13B may be disposed at the same position in which the supply voltage terminal 11A or the ground terminal 11B is formed as shown in FIG. 9. The change $\Delta V(X)$ of the voltage at the position other than the supply voltage terminal 11A or the ground terminal 11B is smaller than the change $\Delta V(0)$ of the voltage at the supply voltage terminal 11A or the ground terminal 11B. The change of the voltage V(0,X) between the voltage output terminals 13A and 13B is $(\Delta V(X)+\Delta V(0))/2$. Therefore, TCR of the resistor of the present embodiment is lower than that of the resistor shown in FIG. 7.

The present invention has been described with reference to the above-mentioned embodiments, but the present invention is not limited to these embodiments and can be modified without departing from the spirit or concept of the present invention. For example, the supply voltage terminal 11A or the ground terminal 11B may be connected to the portion other than the end of the conductive film 1A or the conductive film 1B.

Although all the above embodiments use the rectangular resistive film 2 composed of a thick-film resistor as the resistor 5, the present invention is valid even when the other resistive material which is generally used In a monolithic IC, for example a metallic thin-film resistor, a diffused resistor, poly-Si resistive film or the like, is used.

Figure 10:
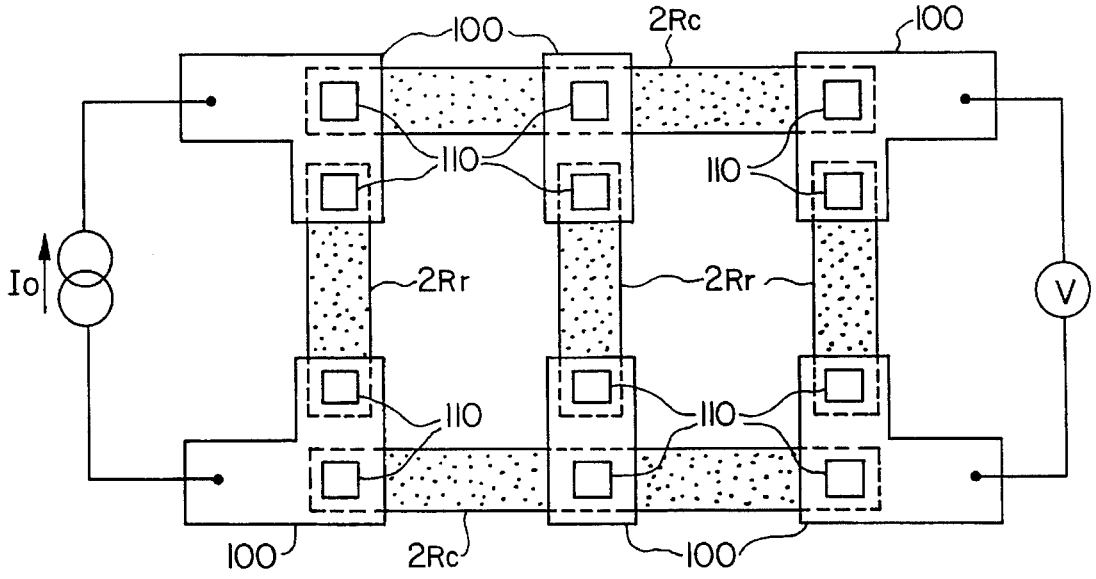
FIG. 10 shows a fourth embodiment of the present invention used in a monolithic integrated circuit environment.

FIG. 10 shows a conceptual plane view of a resistor circuit when the constant-current circuit is constructed by a so-called monolithic IC. In the semiconductor substrate, the diffused resistor layers $\mathbf{2}_{Rr}$, $\mathbf{2}_{Rc}$, are formed and contact with the aluminum lines 100 via contacting holes 110. The aluminum lines 100 are formed on the substrate interposing the insulation film (not shown) therebetween. The diffused resistor layers $\mathbf{2}_{Rr}$, $\mathbf{2}_{Rc}$ are connected to each other by the alumina lines 100 so as to compose the resistor ladder as shown in FIG. 4. This embodiment has the same effect as the above embodiments.

What is claimed is:

1. A constant current circuit for providing a constant current to a load, comprising:

a voltage source coupled to one end of the load;

a controlling source coupled to another end of said load; and a resistive network including a plurality of resistor elements connected together, having a first portion having a first TCR and having a second portion having a second TCR different from said first, values of said first and second portions being selected such that a change in resistance of said first portion due to a change in temperature is equalized by a change in resistance of said second portion due to said change in temperature, to cause operation thereof which is independent in change of ambient temperature.

2. A resistor circuit according to claim 1, wherein said first portion and said second portion provide first and second current paths which are different from one another.

3. A resistor circuit according to claim 2, wherein:

one of said first and second current paths is longer than the other of said first and second current paths; and p1 the longer of said first and second current paths has a larger temperature coefficient of resistance that the other of said current paths.

4. A constant current circuit for providing a constant current to a load, comprising:

a voltage source coupled to one end of the load;

a controlling source coupled to another end of said load; and a resistive ladder network, including a plurality of resistor elements connected in a ladder arrangement, having a first portion, a first voltage across said first portion rising when ambient temperature rises and having a second portion, a second voltage across said second portion falling when ambient temperature rises, values of said first and second portion being selected such that said first voltage across said first portion is equalized by a fall in said second voltage across said second portion, to cause operation thereof which is independent in change of ambient temperature.

5. A circuit as in claim 4 wherein said resistive ladder is formed of a resistive member including:

a first conductive film having a resistance along its length;

a second conductive film having a resistance along its length, spaced from said first conductive film;

a third element which has a resistance across its length, coupled to both said first and second conductive films;

a first conductive terminal coupled to said first conductive film;

a second terminal coupled to said second conductive film;

at least one voltage output terminal, coupled to said first conductive film at a location spaced from said first terminal, said voltage output terminal outputting a voltage.

6. A circuit as in claim 5, said controlling source comprising an operational amplifier having one of its inputs connected to a reference, and another of its input connected to a part of said resistive ladder network.

7. A circuit as in claim 4, said controlling source comprising an operational amplifier having one of its inputs connected to a reference, and another of its inputs connected to a part of said resistive ladder network.

8. A circuit as in claim 4, wherein said resistive ladder network is formed of a first conductive film extending in an axial direction, a second conductive film extending in said axial direction and spaced from said first conductive film, and a third resistance element, formed of a resistive material, connected between said first and second conductive films, wherein at least two of said resistor elements of said resistive ladder network are formed between one point on one conductive film and another point on said one conductive film and at least one resistive element of said resistor network is formed of said resistive material between said first and second conductive films.

9. A circuit as in claim 8 wherein said resistive material is a thick film resistor.

10. A circuit as in claim 8 wherein said resistive material is a resistor from the group consisting of metallic thin film resistors, diffused resistors, and polysilicon resistive films.

11. A circuit as in claim 8 wherein said resistive material is a type of material of a type generally used in a monolithic integrated circuit.

12. A resistor circuit comprising:

a resistor member having an elongated shape along one axis;

first and second resistor terminals, electrically connected to first and second portions of said resistor member respectively, said first and second portions of said resistor member being arranged at one end of said resistor member, near a first location of said one axis;

a current source electrically connected to produce an electric current between said first and second resistor terminals; and a pair of voltage output terminals, electrically connected to third and fourth portions of said resistor member respectively, at least one of said third and fourth portions being arranged at a position apart from said first location where said first and second portions are arranged.

13. A resistor circuit according to claim 12, wherein said resistor member and said resistor terminals form at least three resistive parts, two of which are arranged parallel to said one axis and are connected one to another.

14. A resistor circuit according to claim 13, wherein said resistive parts arranged parallel to said one axis are formed of conductive films and said other resistive part is formed of a thick film resistor.

15. A resistor circuit according to claim 13, wherein said resistive parts are formed of semiconductor diffused layers.

16. A resistor circuit according to claim 12, wherein an electrical characteristic of said first resistor portion and a corresponding electrical characteristic of said second resistor portion are different from one another.

17. A resistor circuit according to claim 16, wherein said electrical characteristic is temperature coefficient of resistance.

18. A resistor circuit according to claim 17, wherein said temperature coefficient of resistance of said first resistor portion is less than said temperature coefficient of resistance of said second resistor portion.

19. A resistive circuit including a constant current circuit, comprising:

a first conductive film having a resistance per unit length;

a second conductive film having a resistance per unit length, spaced from said first conductive film;

a third element which has a resistance per unit length, coupled to both said first and second conductive films;

a first conductive terminal coupled to said first conductive film;

a second conductive terminal coupled to said second conductive film;

a constant current source, applying a constant current between said first and second terminals; and at least one voltage output terminal, coupled to said first conductive film at a location spaced from said first terminal, said voltage output terminal outputting a voltage.

20. A resistance circuit as in claim 19, wherein said first conductive terminal and said at least one voltage output terminal are separated by a first distance.

21. A circuit as in claim 20, wherein said second voltage output terminal and said second conductive terminals are separated by said first distance.

22. A circuit as in claim 20 wherein said second voltage output terminal and said second conductive terminals are separated by a second distance, different from said first distance.

23. A circuit as in claim 22, wherein said first distance is a distance less than an optimal distance which is a distance that would produce a constant output voltage independent of ambient temperature, and said second distance is a distance greater than said optimal distance.

24. A circuit as in claim 22 wherein said first distance is a distance greater than an optimal distance which is a distance that would produce a constant output voltage independent of ambient temperature, and said second distance is a distance less than said optimal distance.

25. A circuit as in claim 20 wherein said first distance is an optimal distance which equalizes a voltage between said voltage output terminals independent or ambient temperature.

26. A resistive circuit as in claim 19 wherein said constant current circuit is formed of a monolithic IC including a plurality of resistive layers.

27. A resistive member as in claim 19 wherein said resistive member is a resistor from the group of resistors consisting of a thick film resistor, a metallic thin film resistor, a diffused resistor, and a polysilicon resistive film.

28. A resistive circuit as in claim 19 wherein a voltage output from said at least one output terminal is taken between said one voltage output terminal and said second conductive terminal.

29. A resistive circuit as in claim 19, further comprising a second voltage output terminal, coupled to said second conductive film at a location spaced from said second terminal, said voltage being output between said at least one and said second voltage output terminals.

* * * * *